US005649674A

United States Patent [19]

Cielker

[11] Patent Number: 5,649,674

[45] Date of Patent: Jul. 22, 1997

[54] EQUIPMENT FOR STORING AND ADVANCING AN ELASTIC MEMBER FOR PULLING A CABLE INTO A CABLE PROTECTING PIPE

[76] Inventor: Werner Cielker, Haus Papillon, D-54587 Birgel, Germany

[21] Appl. No.: 420,811

[22] Filed: Apr. 12, 1995

[30] Foreign Application Priority Data

Apr. 16, 1994 [DE] Germany ..... 44 13 247.6

[51] Int. Cl.[6] ..... B65H 75/30; B65H 75/38; H02G 1/08

[52] U.S. Cl. ..... 242/396.8; 242/405.3; 242/406; 254/134.3 FT

[58] Field of Search ..... 242/396.6, 396.7, 242/396.8, 405.3, 406; 254/134.3 FT

[56] References Cited

U.S. PATENT DOCUMENTS

| | | | |
|---|---|---|---|
| 1,118,270 | 11/1914 | Dahl | 254/134.3 FT |
| 2,300,243 | 10/1942 | Zierden | 242/405.3 |
| 3,381,916 | 5/1968 | Edgell | 242/396.7 |
| 3,415,461 | 12/1968 | Zelnick | 242/396.6 |
| 4,061,290 | 12/1977 | Harrill | 242/405.3 |
| 4,522,349 | 6/1985 | Clerk | 242/396.7 |
| 4,537,215 | 8/1985 | Roman | 242/405.3 |
| 4,557,430 | 12/1985 | Bonhard | 242/405.3 |
| 5,056,731 | 10/1991 | Koehn | 242/405.3 |

FOREIGN PATENT DOCUMENTS

| | | | |
|---|---|---|---|
| 0131219 | 1/1985 | European Pat. Off. | 242/406 |
| 2384700 | 10/1978 | France | 242/405.3 |
| 2752429 | 5/1979 | Germany | 242/117 |

*Primary Examiner*—Daniel P. Stodola
*Assistant Examiner*—Matthew A. Kaness
*Attorney, Agent, or Firm*—Diller, Ramik & Wight, PC

[57] ABSTRACT

Equipment is provided for storing an elastic member or "snake" which is coiled on a drum and can be uncoiled and pushed through a protective pipe incident to attaching a cable thereto and retracting the snake to pull the cable into the protective pipe. The equipment includes a housing, a generally hollow annular drum and a crank arm for both rotating the storage drum and defining a bushing in conjunction with a bushing of the housing. The latter bushings are selectively coupled and uncoupled to permit the components to be rapidly disassembled so that storage drums carrying different snakes can be substituted relative to the equipment depending upon the task at hand.

26 Claims, 12 Drawing Sheets

1
6
7
11
12
13
14
15
17
32
35
41
49
X
XI
XII
XIII 2
3
5
11
18
20
21
22
26
27
28
37
42
63
64
65
66
XVIII
XX

XXII
XXI
XXI
1
6
6
7
7
7
7
7
10'
10'
11
12
15
51
52
53
55
56
57
58
67
68
69
70
71
71
71
71
72
72
72
72
72
73
74
75

EQUIPMENT FOR STORING AND ADVANCING AN ELASTIC MEMBER FOR PULLING A CABLE INTO A CABLE PROTECTING PIPE

BACKGROUND OF THE INVENTION

The invention is related to equipment which includes a drum upon which an elastic member, normally called a snake, can be wrapped and from which the same can be unwound and fed into a cable protecting pipe or a similar empty pipe. An end of the elastic member exits the pipe and the cable is attached to this end with subsequent rotation being imparted to the drum effecting the rewinding of the elastic member upon the drum and the cable being pulled into the cable protecting pipe.

DESCRIPTION OF RELATED ART

German Patent Document 30 31 570 C3 disclosed equipment of the type described which is imminently suited to its intended purpose, namely, snaking cables or other electrical conductors into cable protecting pipes or any other variety of empty pipes. Such conventional equipment stores the elongated elastic member or snake upon a drum and the elongated member is normally constructed from metallic material which is pre-stressed to bias it to a straight configuration. The equipment comprises a disk-shaped storage drum and the elastic member, because of its bias, comes to rests against an inside wall of the drum. The storage drum is rotatably supported in a matching housing which encloses the drum on all sides, and thus the housing is also closed on all sides. The drum has a circular gap and the housing has an aperture opposite the gap to allow the elastic member to be drawn out of the equipment. The elastic member is pulled from the housing which rotates the drum and is simultaneously pushed into the cable protecting pipe until it exits the latter. A cable is attached to the end of the elastic member and is subsequently pulled into the protective pipe. During and upon the completion of the pulling operation, the elastic member is wound back into the equipment for storage therein.

It has been found in practice that substantial force must be applied to feed the elastic member into a cable or cable protecting pipe because of the friction between the elastic member and the interior surface of the cable protecting pipe which also increases with increasing length of insertion. The difficulty is compounded because cable protecting pipes often have bends therein or because other cables are already present thereby decreasing the space and increasing the friction. At times a worker is unable to apply sufficient thrust to manually insert the "snake" through the protective pipe, and at times the elastic member is excessively bent or kinked rendering it essentially useless for subsequent operation. The latter problem has been solved to a certain extent by the development of special accessory tongs for inserting and/or pulling the elastic member into and out of the associated protective pipe. However, the latter requires the worker to operate two apparatuses simultaneously which turns out to be a fairly complex and time consuming proposition. Additionally, practice has indicated that elastic members or snakes of different lengths and of different thicknesses are required for varying applications, but such cannot be readily exchanged or interchanged in a simple manner in presently known equipment.

SUMMARY OF THE INVENTION

An object of the present invention is to provide novel equipment which is easily operable even in the face of the most stringent demands by providing a drum which can be readily assembled and disassembled from a housing so that drums carrying coiled snakes of varying lengths and thicknesses can be readily substituted one for another. The equipment includes a housing which is defined as a unilaterally opening shell within which seats a generally hollow annular drum housing the elastic snake with a removable hand crank being utilized to secure the components of the equipment together and to provide rotation to the drum which allows the application of high tensile and thrust forces to the snake by rotating the drum in either of both directions for pushing and pulling purposes.

DESCRIPTION OF THE PREFERRED EMBODIMENT

A first embodiment of the invention is fully illustrated in FIGS. 1 through 13 of the drawings in which the novel equipment is shown to include three basic components, namely, a housing 1, a hollow annular storage drum 2, and a hand crank or crank arm 4.

Figure 7:
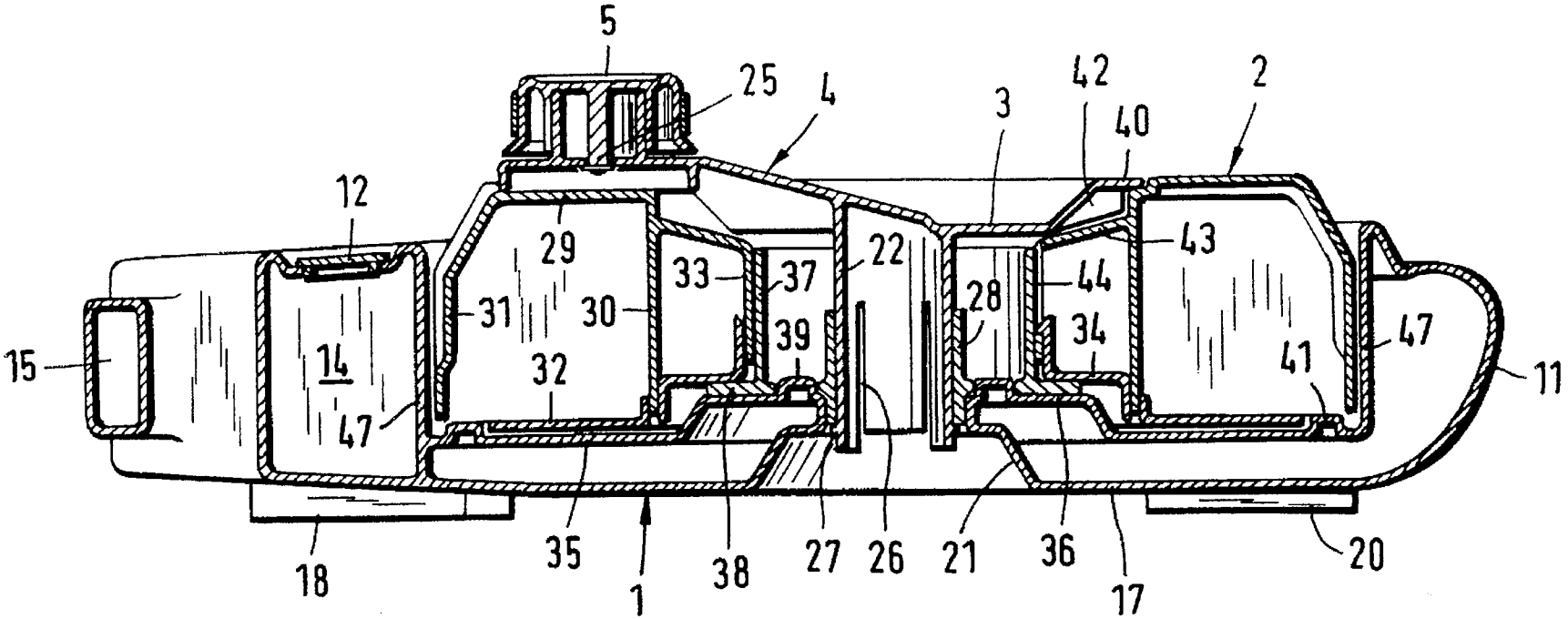
FIG. 7 is a longitudinal cross-sectional view taken through the axis of rotation of the drum of the equipment, and illustrates three major parts of the equipment, namely, a housing, a hollow annular storage drum, and a crank arm or hand crank.
Figure 8:
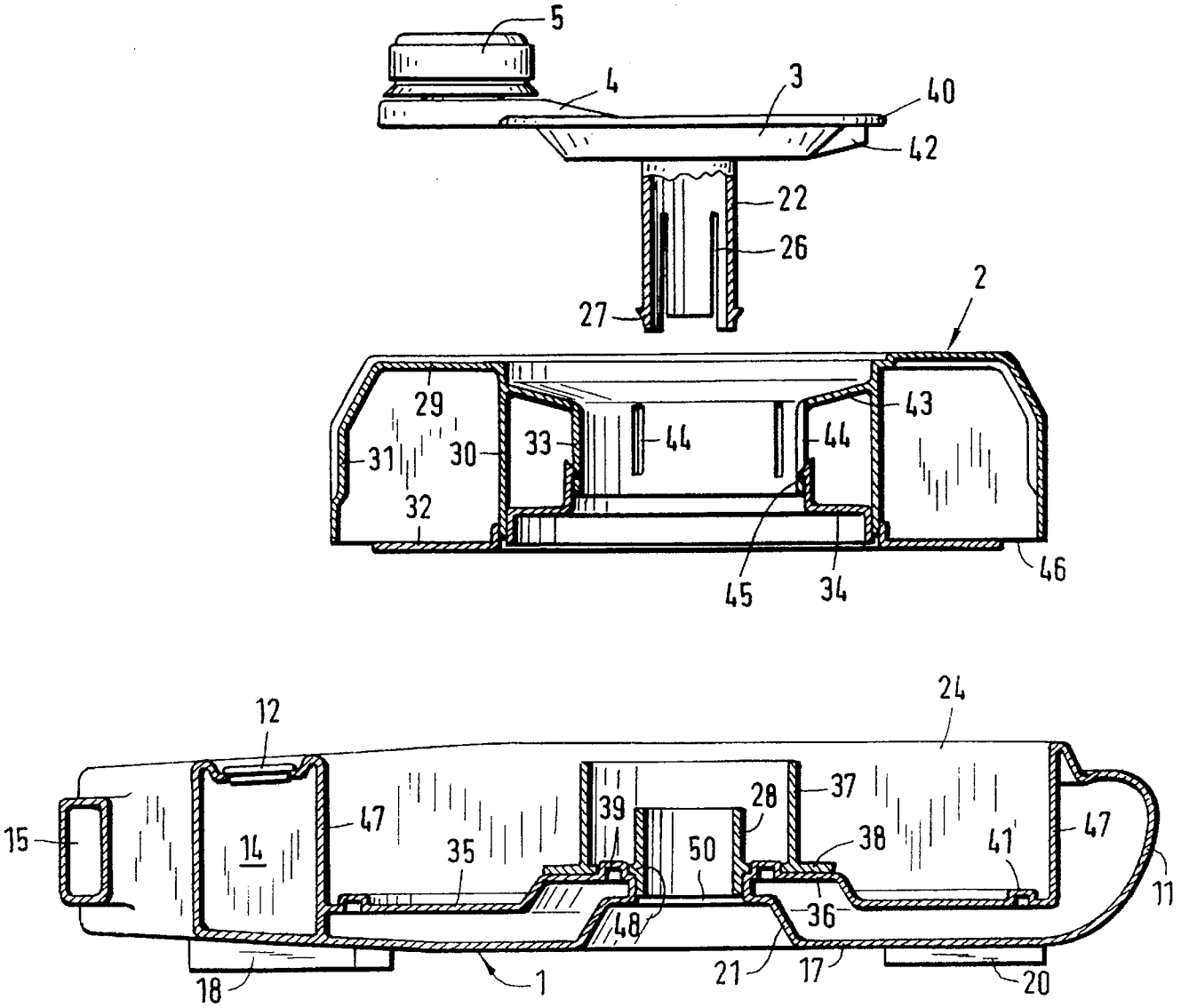
FIG. 8 is an exploded view of the equipment, and illustrates in detail the housing, storage drum and crank arm thereof.

The housing 1 is a hollow shell and is generally open in an upward direction, as is best shown in FIG. 8. The storage drum 2 is placed in an opening 24 of the housing 1 from above, as is most readily apparent from FIG. 8 and, therefore, is readily accessible and interchangeable, together with an elastic member or "snake" 7 stored therein. The storage drum 2 is rotated by a hand drive generally defined by the hand crank 4 which imparts rotation to the storage drum 2 as a rotatable grip 5 is grasped and rotated to rotate the hand crank 4 and a generally conical disk 3 thereof. The housing 1 includes a generally upwardly opening U-shaped channel guide 6 formed integrally with the housing 1 which extends outwardly approximately tangentially to the circumference of the storage drum 2, as is most readily envisioned in FIG. 1 of the drawings. The elastic member 7 slides in the guide 6 and may include at a terminal end (unnumbered) thereof with a screw connection 10 (FIGS. 1 and 2) for affixing thereto an elastic fitting 9 carrying an elongated tapered guide head 8. An outwardly convex rest 11 is defined by the housing 1 adjacent the guide 6. Opposite the rest 11 is a hollow chamber or receptacle 14 (FIGS. 1, 7 and 8) for accessories which can be accessed through an appropriate lid or cover 12 secured to the housing by conventional hinges (not shown). A conventional lid lock 13 can hold the lid 12 locked yet permit the opening thereof. Preferably a carrying grip 15 is of an integral construction defining part of the housing 1 adjacent the receptacle 14.

The housing 1 includes a base or base wall 17 which is substantially planar and has integrally formed therein three feet 18, 19 and 20. A generally frusto-conical wall or wall portion 21 defines a downwardly opening recess (unnumbered) and a circular aperture thereof (also unnumbered) telescopically received internally thereof a tubular bearing or tubular bush or bushing 22 (FIGS. 7 and 8) depending downwardly from the crank arm 4. A pivot pin 25 (FIG. 7) also connects the crank arm 4 to the hand grip 5 to allow the crank arm 4 to be readily rotated about the axis (unnumbered) of the tubular bush 22. Rotation of the crank arm 4 imparts rotation to the storage drum 2 through one or more ribs 42 (FIG. 7) projecting downwardly from the crank arm 4 adjacent a peripheral edge 40 of the conical disk 3 which engage in one or more axially upwardly opening slots (unnumbered) of an upper convex drum wall portion 43 of the storage drum 2. Several of such ribs 42 can be distributed along the circumference of the conical disk 3 or in lieu thereof the conical disk 3 can simply be in mating frictional driving relationship to the drum wall portion 43 of the storage drum 2.

The bush 22 of the crank arm 4 carries a plurality of outwardly projecting catches 27. The catches 27 engage beneath and lock with a tubular bush or bushing 28 snapped in or bonded to the opening (unnumbered) defined by a short cylindrical wall portion 50 (FIG. 8) adjacent the frusto-conical wall portion 21. The bush 22 has a plurality of slots 26 extending parallel to the bush axis (not shown) which imparts lateral or radial elasticity to the bush 22 such that the projections or catches 27 can be deflected radially inwardly to release the same from the underside of the bush 28, as shown in FIG. 8, to release the crank arm 4 and permit the storage drum 2 to be readily withdrawn from the upper opening 24 of the housing 1 (FIG. 8). The opening 24 includes a peripheral wall 47 corresponding generally in diameter to the exterior diameter of the storage drum 2, as is most readily apparent from FIGS. 7 and 8. The catches or projections 27 are so large and so rugged as the same will not be worn significantly even after long service, and thus maintain the storage drum 2 in the opening 24 of the housing 1 in an easily rotatable and accessible manner.

The housing 1 additionally includes a wall 35 (FIG. 8) having at an outer periphery thereof an upwardly projecting circular or annular boss or rib 41. The rib 41 enters a circular or annular gap 46 (FIGS. 7 and 8) defined between a bottom or base wall 32 and an outer drum wall 31 of the storage drum 2. The storage drum 2 also includes an upper annular drum wall 29 and an innermost drum wall 30 with the latter carrying an integral frusto-conical wall 43 (FIG. 8) which in turn includes a cylindrical wall 33 having a plurality of axially extending parallel slots 44 which are engaged by radially inwardly directed projections 45 of a wall 34 (FIGS. 7 and 8). The function of the cylindrical wall 33 will become apparent more fully hereinafter. The upper drum wall 29 and the outer drum wall 31 have respective reinforcing channels 16 and 23, as is readily apparent in FIGS. 1, 3 and 4 of the drawings.

Figures 9, 10, 11, 12, 13:
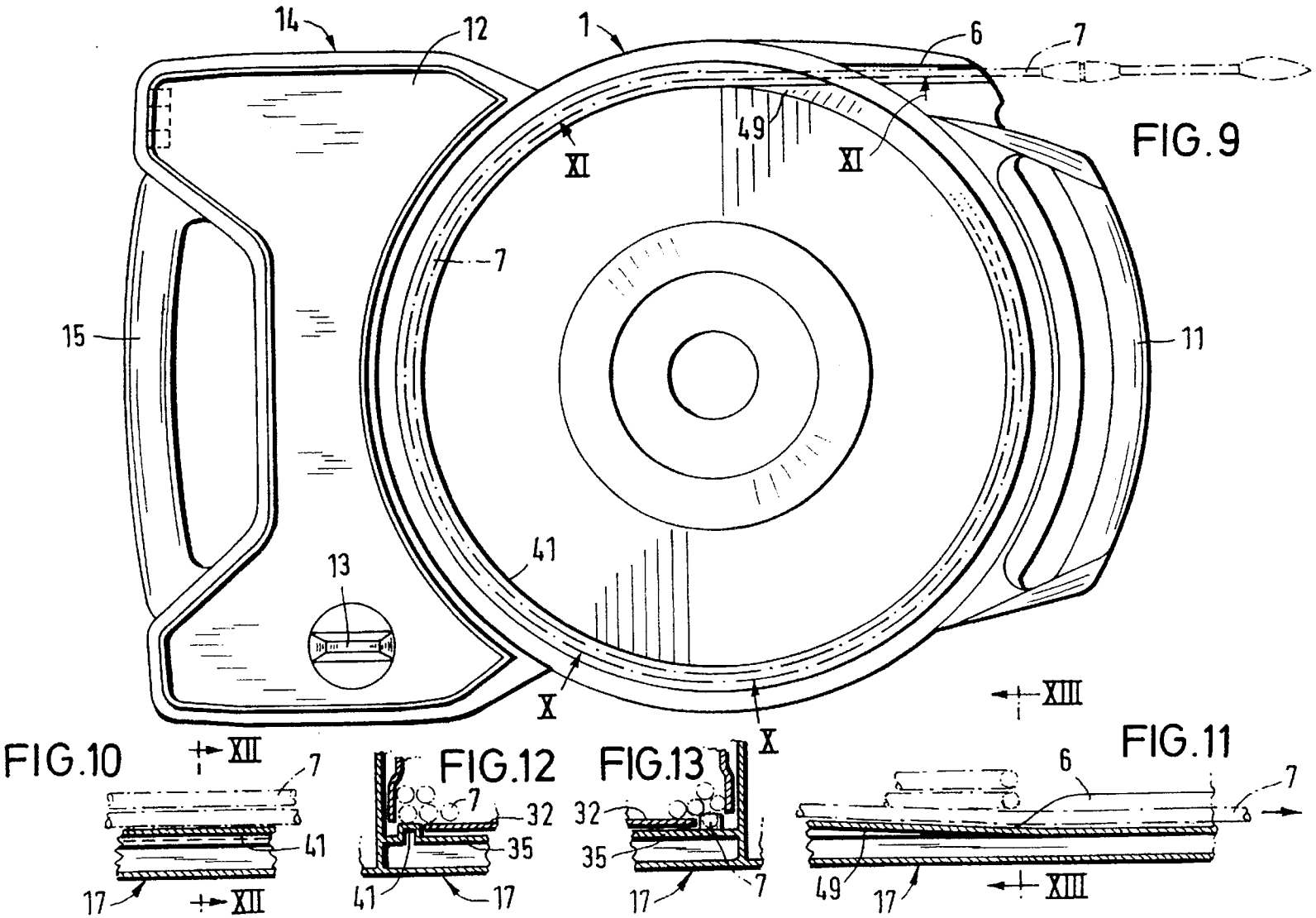
FIG. 9 is a top plan view of the equipment with the crank arm and storage drum removed, and illustrates an upwardly projecting generally annular rib of a base of the housing which is received in an annular groove or slot of the storage drum.
FIG. 10 is a fragmentary cross-sectional view taken generally along line X—X of FIG. 9, and illustrates the upstanding annular or circular rib and the manner in which the elastic member or snake is seated thereupon.
FIG. 11 is a fragmentary cross-sectional view taken generally along line XI—XI of FIG. 9, and illustrates an area in which the circular rib terminates along a tapered wall adjacent a guide channel of the housing.
FIG. 12 is a fragmentary cross-sectional view taken generally along line XII—XII of FIG. 10, and illustrates the manner in which the annular rib of the base or housing is accommodated in the annular groove of the storage drum.
FIG. 13 is a cross-sectional view taken generally along line XIII—XIII of FIG. 11, and illustrates the manner in which a portion of the elastic member rides or slides along the tapering wall of FIG. 11.

As is most readily apparent in FIGS. 8 through 13 of the drawings, the annular rib 41 projects into the circular gap 46 along substantially the entirety of the latter to form a seal therewith except for a short arcuate portion defined by a tapering wall 49 which merges with the bottom wall 35 at the guide 6 (FIG. 11). As is most readily apparent in FIG. 12, the annular rib 41 prevents any of the coils of the elastic member or snake 7 from exiting the generally circular or annular gap 46, but the latter defines an aperture (unnumbered) with the wall 49 through which the elastic member 7 can exit the drum 2 in the manner readily apparent in FIGS. 9 and 11 of the drawings.

As is most also most evident from FIGS. 7 and 8 of the drawings, in addition to the alignment provided by the telescopic relationship between the bushes 22, 28, the bottom wall 35 of the housing 1 includes an annular portion 36 from which upwardly projects an annular boss or rib 39. A circumferential rib 48 of the bush 28 seats against an inner cylindrical wall (unnumbered) of the annular rib 39 (FIG. 8), and the annular rib 39 is engaged within a circular opening (unnumbered) defined by a flange 38 having an upwardly directed tubular cylindrical bush or bushing 37. The wall 36 is bonded or otherwise secured to the flange 38. The bush 37 is internally telescopically received within the wall 33 of the storage drum 2, and in this fashion axial alignment between the drum 2 and the housing 1 is effected by two cooperative pairs of bushes, namely, the bushes 22, 28 and the bushes 33, 37. This assures that the storage drum 2 is effectively supported and guided during its rotation by the hand crank 4 and wear which might otherwise occur due to relative wobbling between the components 1, 2 and 4 is essentially precluded. Furthermore, the bushes 33 and 37 facilitate the guiding of the storage drum 2 into the opening 24 during assembly and, of course, the bush 28 facilitates the guidance of the bush 22 therein, and this improved centering thus also facilitates equipment assembly.

Figure 1:
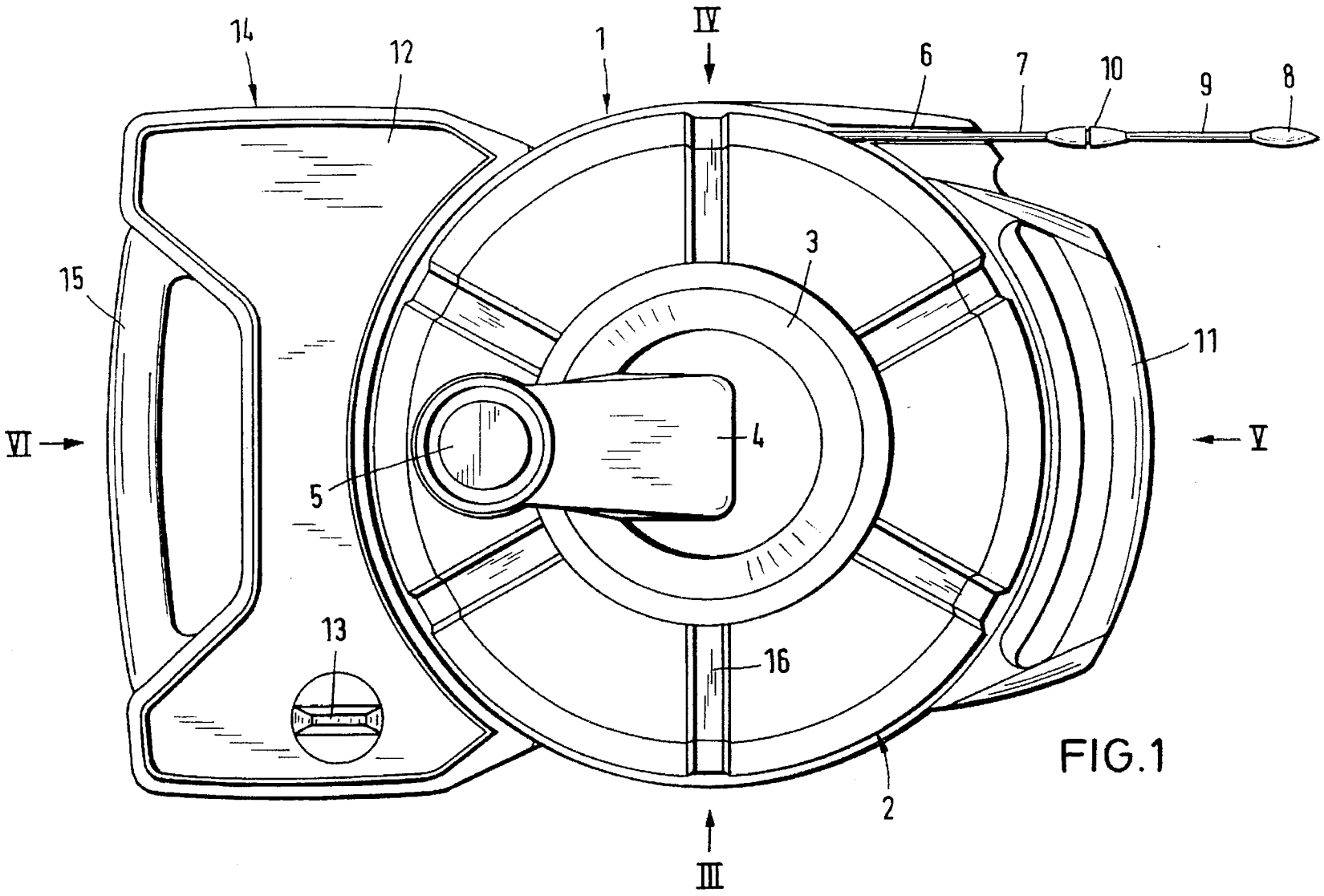
FIG. 1 is a top plan view of the equipment, and illustrates an end of an elastic member or snake projecting beyond a guide outwardly of a housing which includes a hand grip and a hand crank for rotating an associated drum about which the elastic member or snake is wound.
Figure 2:
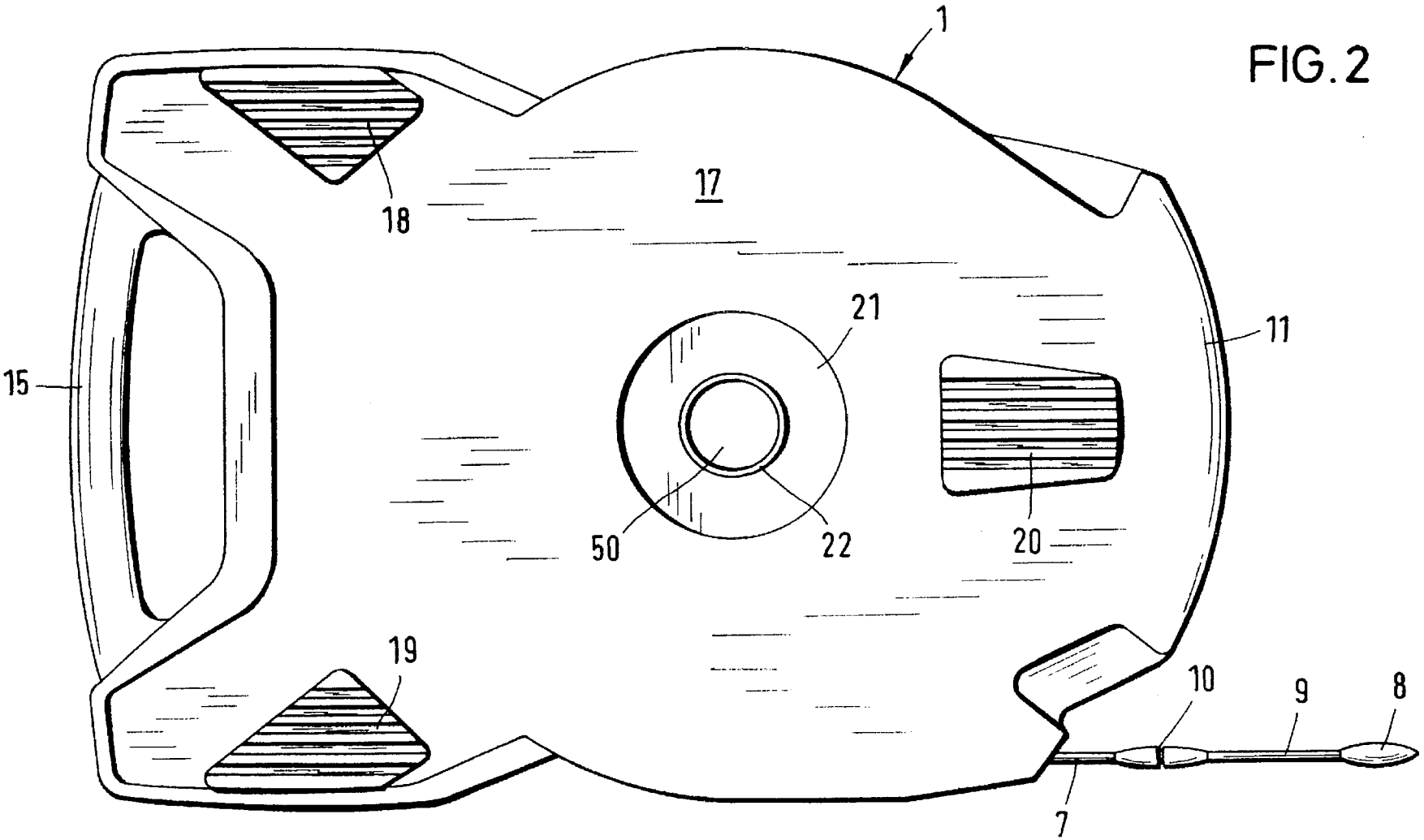
FIG. 2 is a bottom view of the equipment, and illustrates three feet integrally formed in a bottom wall of the housing.
Figure 3:
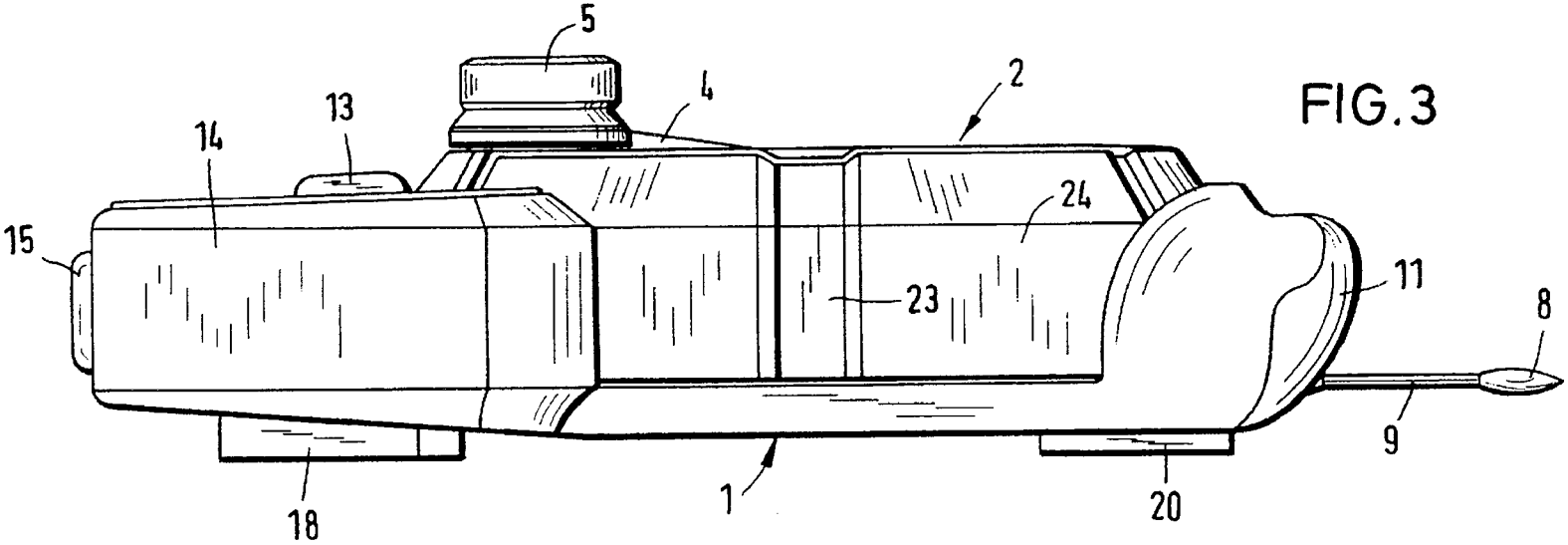
FIG. 3 is a side elevational view looking in the direction of the arrow III of FIG. 1, and illustrates ribs reinforcing a top wall and a side wall of a shell of the housing of the equipment.

It is to be understood that several storage drums 2 are provided of the generally same size and shape as that illustrated, but each includes a different elastic member or snake 7 so that depending upon the particular task at hand, a particular storage drum 2 and its associated elastic member 7 is selected and seated within the opening 24 of the housing 1 with, of course, the end thereof in the slot 6 with the screw connection 10 externally of the latter (FIG. 1). With the bushes 22, 28 and 33, 37 in generally nested telescopic relationship, the crank arm 4 is pushed downwardly until the projections 27 engage beneath the bush 28 generally in an area of the wall 50 (FIGS. 7 and 8). Drum exchanges are performed by simply deflecting the bush 22 radially inwardly to disengage the projections 27 from beneath the lower edge of the bush 28 adjacent the cylindrical wall 50.

In operation, the equipment is placed upon its feet 18–20 on a suitable support surface and/or with the convex rest 11 against a wall, whereupon the equipment is held by one hand on the grip 15 while the other hand drives the crank 4. The elastic member or snake 7 is fed through an appropriate pipe and upon exiting the far end thereof, a cable is secured to the snake 7 and the latter is retracted into the storage drum 2 by rotating the crank 4 in an opposite direction.

Figure 14:
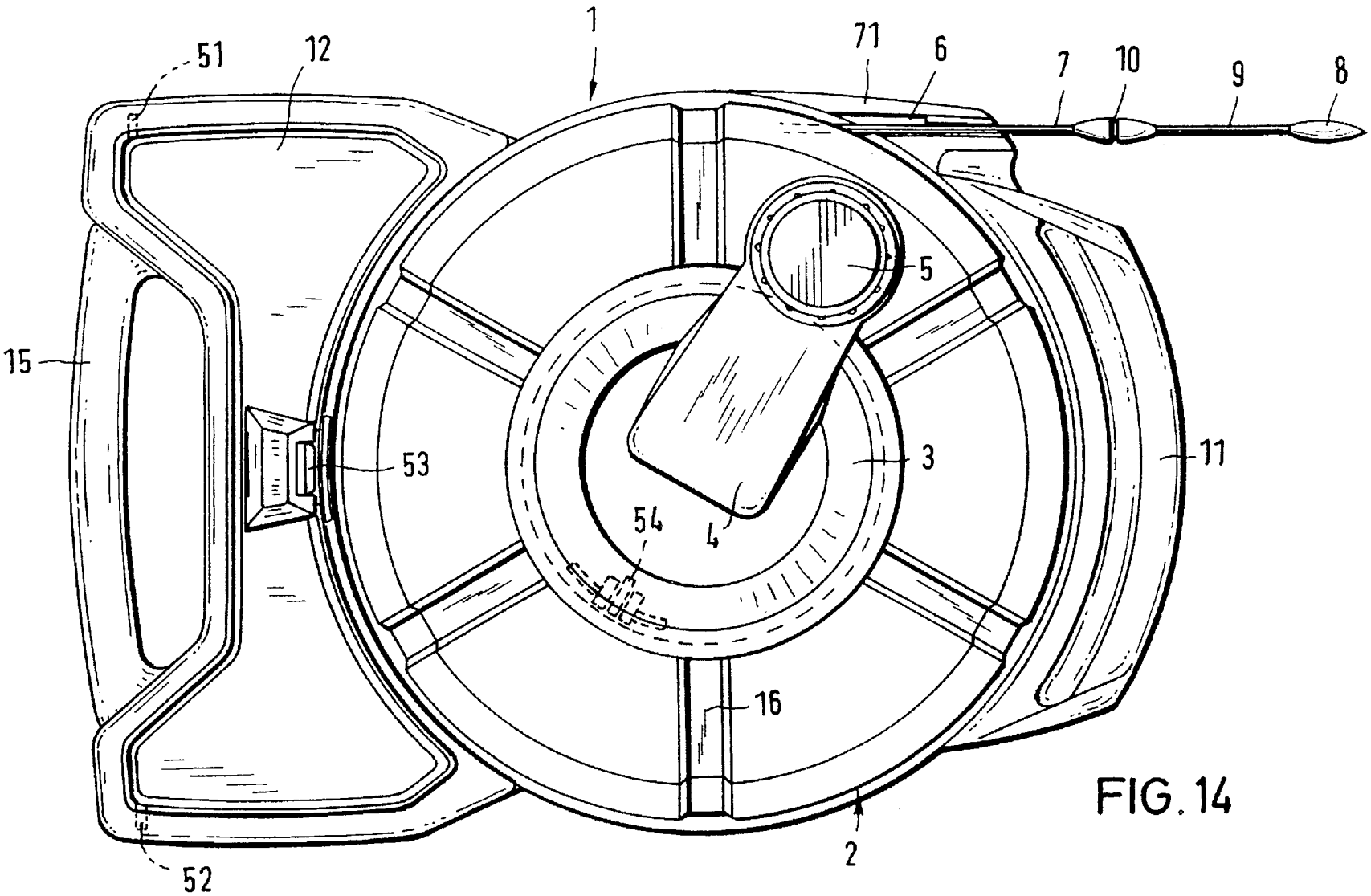
FIG. 14 is a top plan view of other equipment constructed in accordance with this invention, and illustrates details of a pivoted lid closing a storage chamber adjacent a handle of a housing of the equipment and in phantom outline interdigitated ribs of a crank arm and a storage drum for providing a drive connection therebetween.
Figure 15:
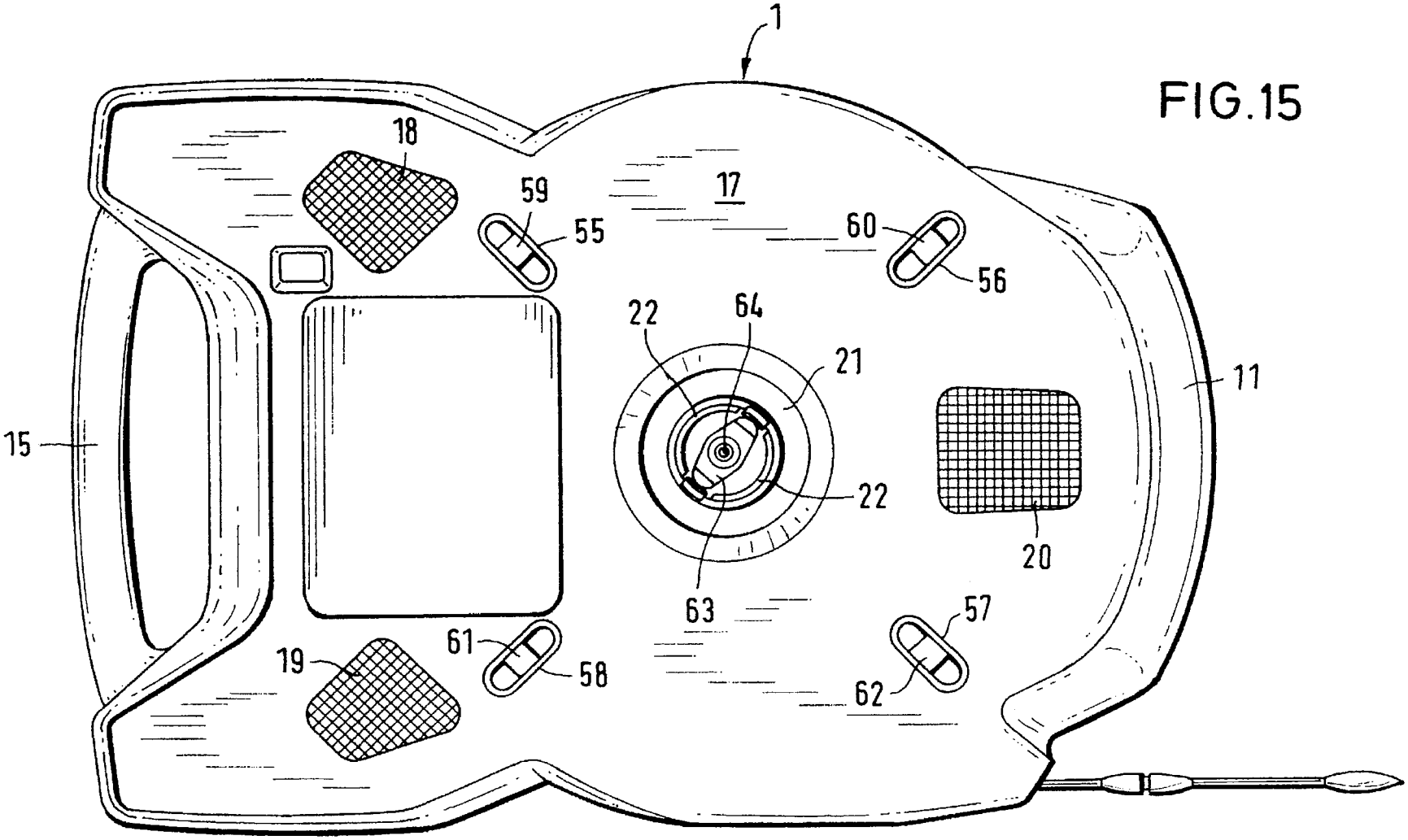
FIG. 15 is a bottom view of the equipment of FIG. 14, and illustrates four sliders for selectively permitting and preventing rotation of the storage drum and a manually rotatable element for preventing inadvertent unlocking of the crank arm relative to the housing.
Figures 16, 17:
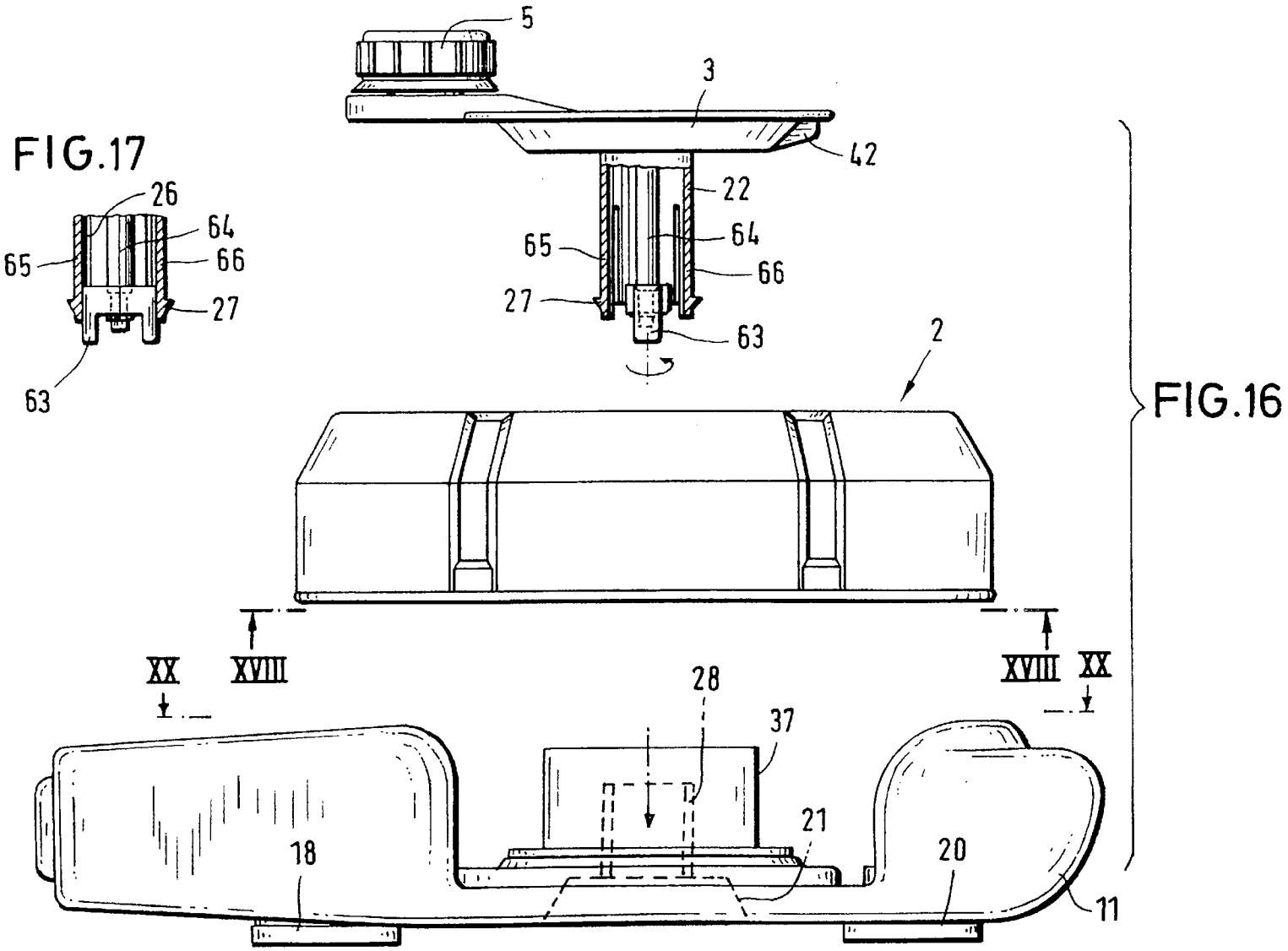
FIG. 16 is an exploded view of the equipment of FIGS. 14 and 15, and illustrates details of the manually rotatable element and locking projections carried by a generally tubular bushing projecting downwardly from the crank arm.
FIG. 17 is a fragmentary view of a lower portion of the tubular bushing of FIG. 16, and illustrates the rotatable element in a position in which the locking projections are held in radially outermost locking positions thereof.

Reference is now made to FIGS. 14 through 25 of the drawings which illustrate further embodiments of the equipment of the present invention wherein like structure is identically numbered, though primed, to indicate structure identical to that of the embodiment of the invention illustrated in FIGS. 1 through 13 of the drawings. In FIGS. 14 through 16 a lid 12' is conventionally pivoted at 51, 52 at a top side of a receptacle 14' at both sides of a carrying grip 15'. These pivot bearings 51, 52 may simply be pivot pins which, as shown in FIG. 14, are mounted at outer corners of the lid 12' and enter bore holes (unnumbered) of the adjacent parts of a housing 1'. Lid closure means 53 in the form of a snap lock is mounted at a mid-portion of the lid 12' near the periphery of a storage drum 2'. An elastic tab may be actuated to open the lid, for instance a tab which, when the lid 12' is being closed, by means of a beak, engages the rear edge (unnumbered) of an edge of the housing 1'. A plurality of snap-in ribs 54 are provided at the top side of an inner drum wall portion 43' which snap-engage in a gap between a pair of ribs at the underside of the disk 3' and which, in the assembled condition of the equipment establish a positive connection between the storage drum 2' and the disk 3' to effect rotation via the hand crank 4'.

Figure 18:
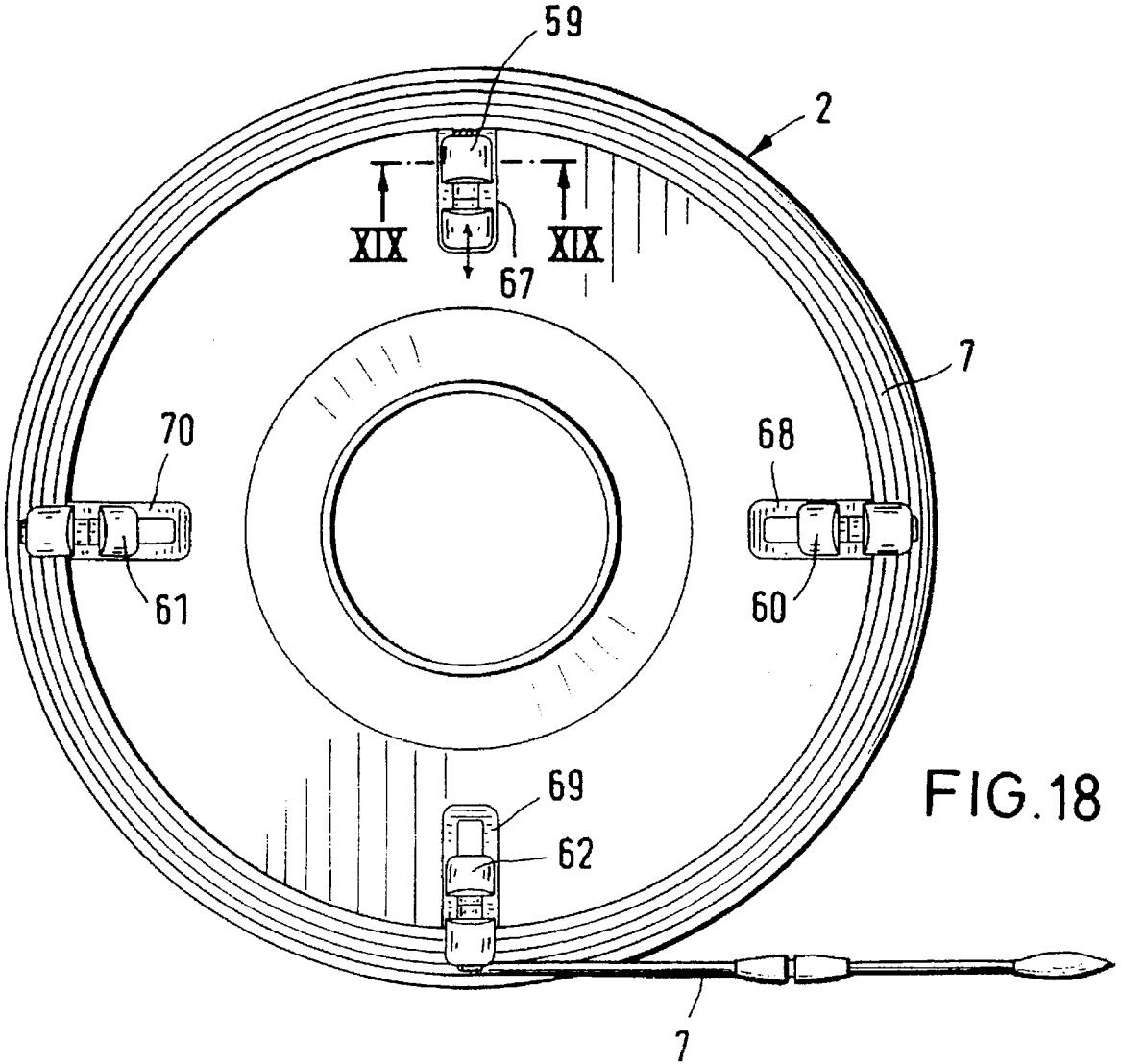
FIG. 18 is a bottom view of the storage drum of FIG. 1, and illustrates radially slidable members which can be radially shifted or slid to prevent or permit rotation of the storage drum.
Figure 19:
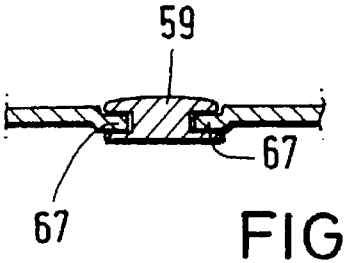
FIG. 19 is an enlarged cross-sectional view taken generally along line XIX—XIX of FIG. 18, and illustrates details of one of the radially slidable locking members or elements.
Figures 20, 21, 22, 23, 24, 25:
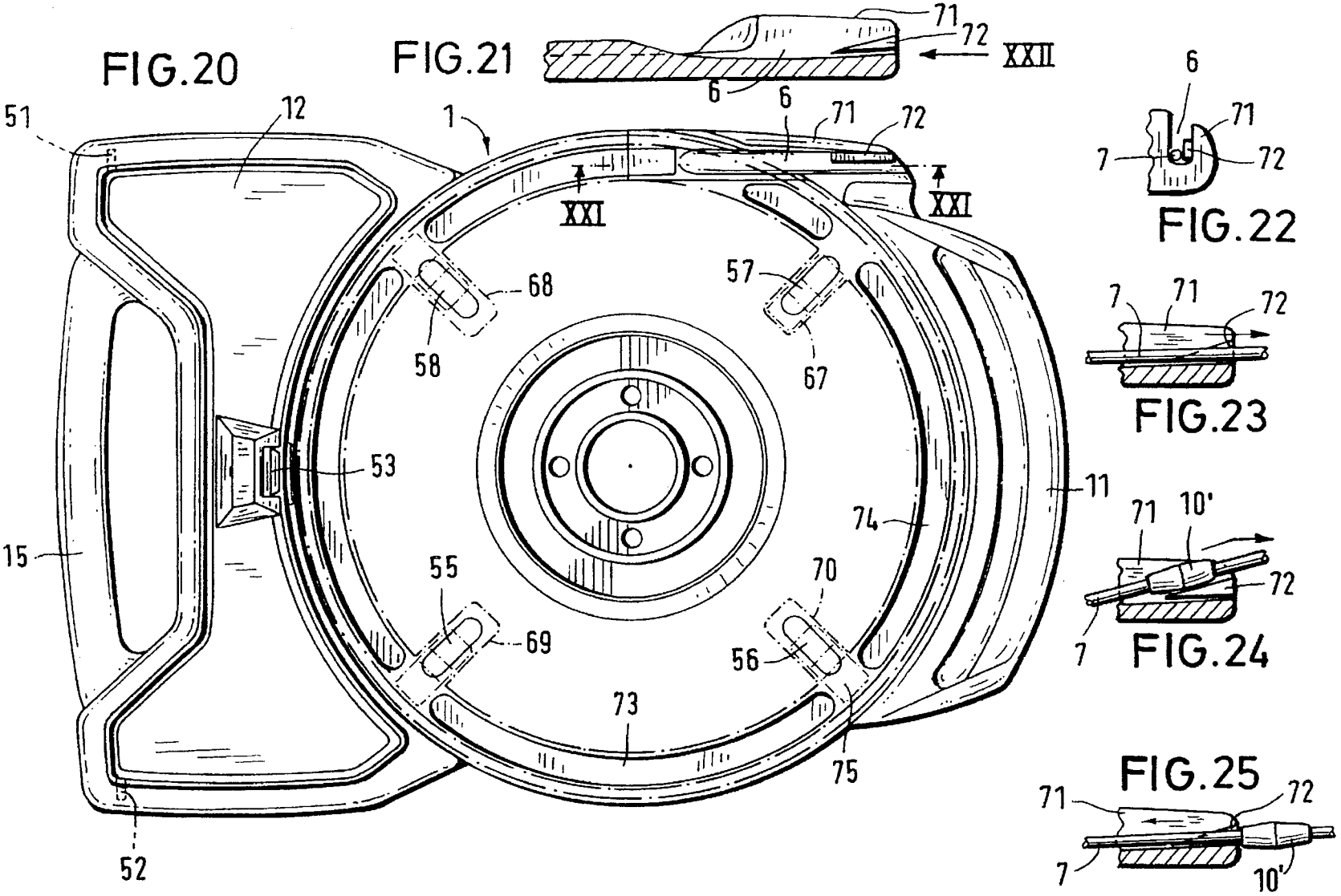
FIG. 20 is a top plan view of the housing of FIG. 1 with the storage drum removed, and illustrates a plurality of spaced arcuate ribs defining spaces therebetween in which can be shifted the locking elements to prevent rotation of the storage drum.
FIG. 21 is a fragmentary cross-sectional view taken generally along line XXI—XXI of FIG. 20, and illustrates a wedge associated with an upwardly opening guide channel which cooperates with an end portion of the elastic member to permit outfeed thereof while precluding undesired retraction.
FIG. 22 is a fragmentary front elevational view taken generally in the direction of the arrow XXII of FIG. 21, and illustrates one position of the elastic member relative to the wedge.
FIG. 23 is a fragmentary view similar to FIG. 21, and illustrates the elastic member exiting the guide channel by sliding past the wedge.
FIG. 24 is a fragmentary view similar to FIG. 21, and illustrates a threaded connection of the elastic member and the manner in which the threaded connection rides along an upper surface of the wedge as it exits the guide channel.
FIG. 25 is a fragmentary view similar to FIG. 21, and illustrates the manner in which the wedge abuts the threaded or screw connection and forms a lock against further inward retraction of the elastic member.

Reference is now made to FIGS. 15, 18, 19 and 20 which illustrate sliders 59–62 at the base of the storage drum 2' which prevent the elastic bar or snake 7' wound in the storage drum 2' from leaving the latter through the circumferential slot 6' when the sliders are in an outermost position, as shown by the sliders 60, 61 and 62 of FIG. 18. This allows the storage drum 2' to be removed from the housing 1' and be exchanged for another storage drum and associated snake. The sliders 59–62 are held in radial slider guides 67–70, respectively (FIG. 18). When the sliders 59–62 are in their outermost positions, as shown in FIG. 18 relative to the sliders 60–62 and as illustrated in FIG. 20 by the dash-dot lines for the slider guides 68, 69 and 70, the outer slider parts (unnumbered) engage gaps or slots 75 between spaced ribs 73 of the housing 1' whereby the storage drum 2' is secured against the rotation inside the housing 1' and thus cannot rotate accidentally which also precludes the snake 7' from accidentally exiting the storage drum 2'. When the sliders 59–62 are in the radially inward position in the manner of the slider 59 of FIG. 18, the equipment of the invention is operable and the storage drum 2' can be rotated to advance or retract the snake 7'. As is shown particularly by FIG. 15, radial elongated apertures 55, 56, 57 and 58 are present in the base of the housing 1' so that the sliders can be actuated relatively simply by, for example, a screwdriver or other similar tool.

A pivot shaft 64 is also illustrated in FIGS. 15–17 which is coaxially mounted in the tubular bearing bush 22' and which carries a pivotal or rotatable grip 63. The grip 63 can be rotated between two positions, namely, a first position shown in FIG. 17 wherein tabs 65, 66 having with catches 27' of the bush 22' are pressed outwardly into the locked position and a second position shown in the upper part of FIG. 16 wherein the tabs 65 and 66 are released and can elastically deflect inward. The assembly and dismantling of the individual components of the equipment of the invention, in particular with respect to changing the storage drum 2', is thereby facilitated while secure assembly is ensured in the operational position of the grip 63 (FIG. 17).

Figure 4:
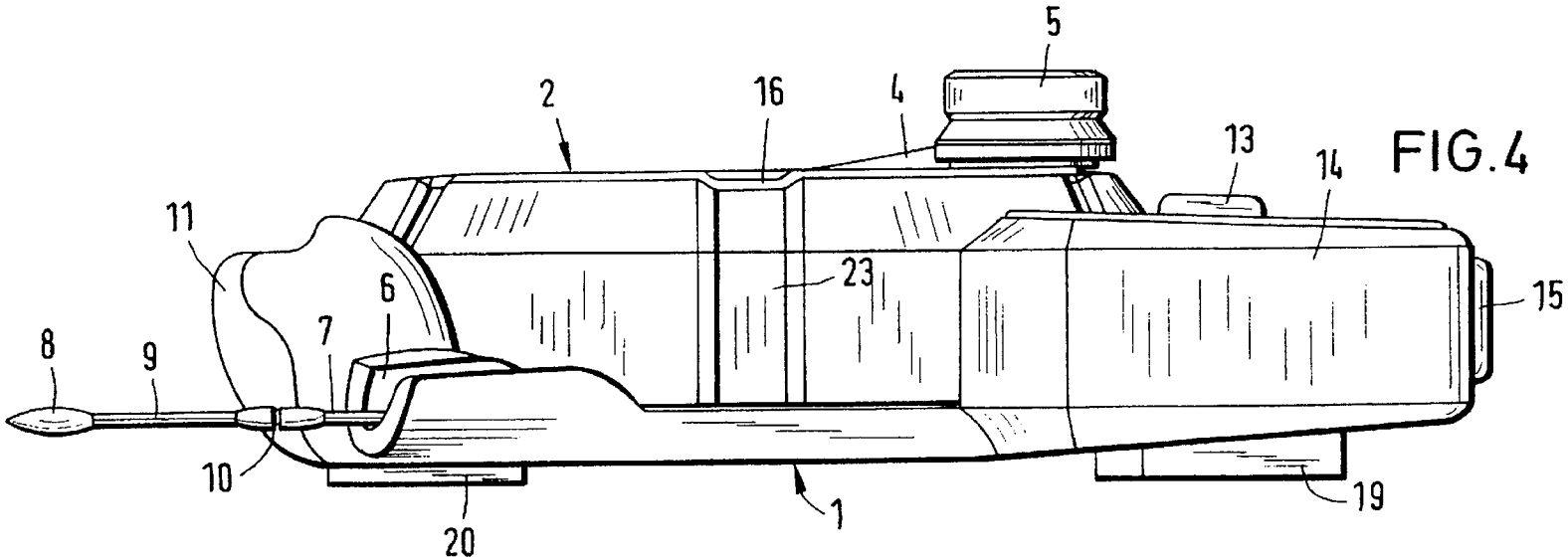
FIG. 4 is a side view looking in the direction of the arrow IV of FIG. 1, and illustrates the generally U-shaped configuration of the guide associated with the elastic member.
Figure 5:
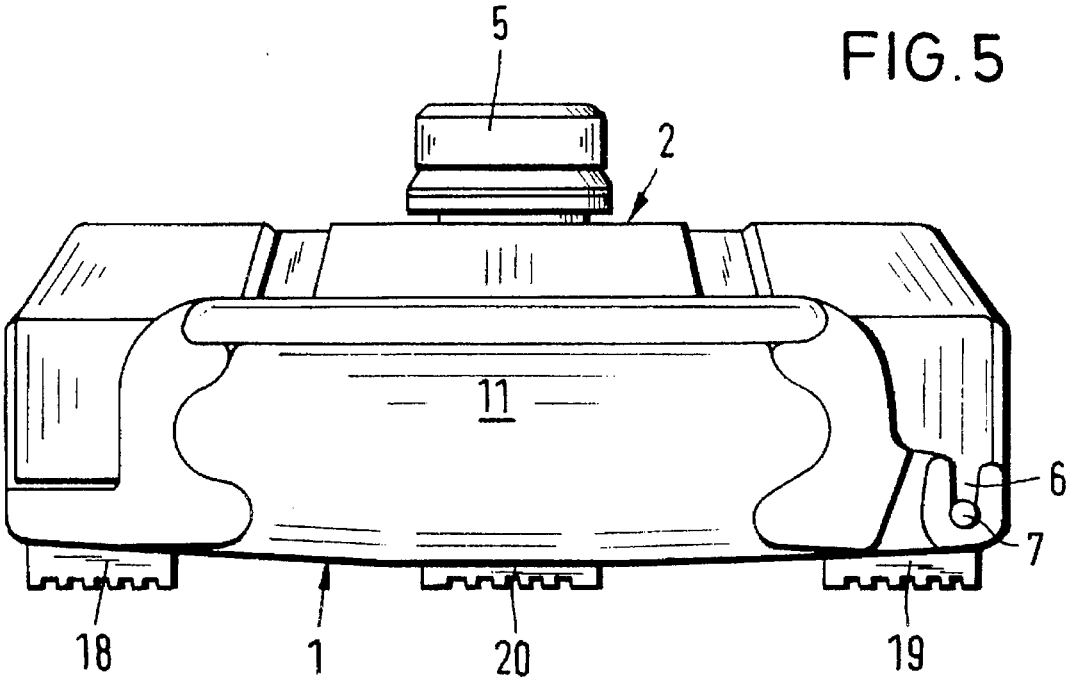
FIG. 5 is a front view taken in the direction of the arrow V of FIG. 1, and illustrates details of the equipment.
Figure 6:
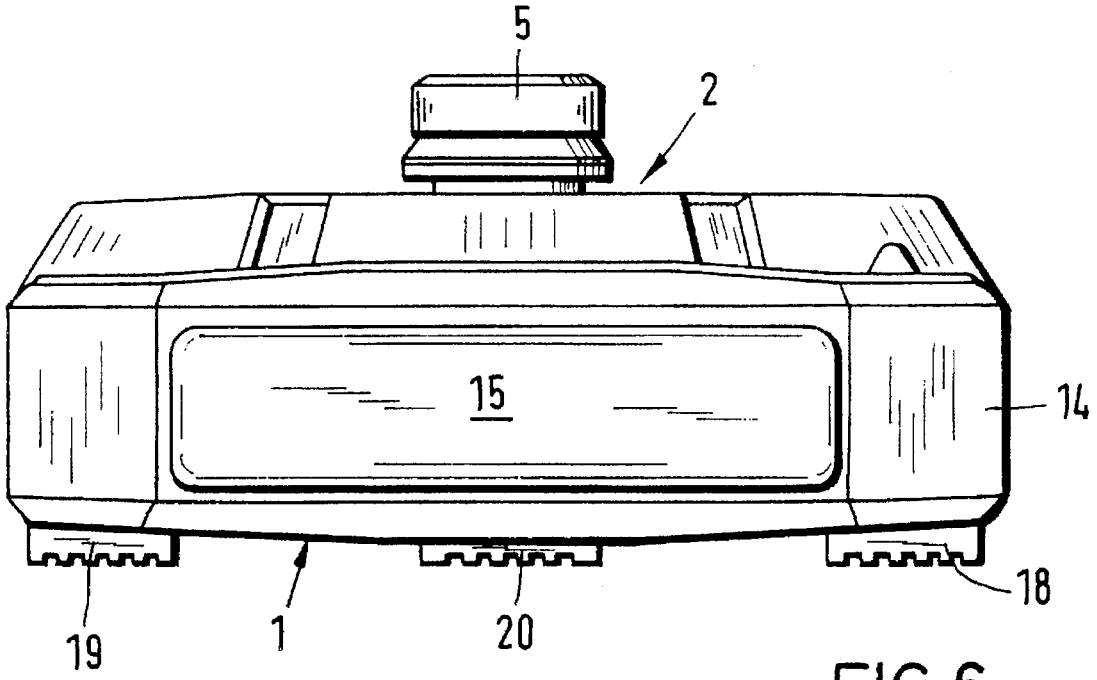
FIG. 6 is a front view taken in the direction of the arrow VI of FIG. 1, and illustrates further details of the equipment.

In FIGS. 20 through 25 the guide 6' includes an element or wedge 72 rising outwardly or in the exit direction of the guide 6' and essentially integral with an outer wall 71 thereof. In addition to providing for reinforcement, the wedge 72 functions in the manner best depicted in FIGS. 22 through 25 of the drawings. In FIGS. 22 and 23, the elastic member 7' moves in the guide 6' adjacent or alongside the wedge 72 as the snake 7' is drawn outwardly, as indicated by the unnumbered arrow associated therewith in FIG. 23. As the screw connection 10' exits the guide 6', the screw connection 10' rides along the wedge 72, as is shown in FIG. 24, and thus constant feed of the snake 7' is assured outwardly of the guide 6'. However, during retraction (FIG. 25), the screw connection 10' will abut the wedge 72 and maintain the outer head 8' to the right of the wedge 72, as is apparent though not illustrated in FIG. 25. Therefore, the wedge 72 prevents the snake 7' from being drawn inwardly beyond the position shown in FIG. 25. The wedge 72 is particularly advantageous if, for example, the snake 7' breaks along its length and the two parts are attached by screw connectors corresponding to the screw connector 10'. No matter how many of such screw connectors 10' are along the length of the snake 7', the latter will feed outwardly of the guide slot 6' beyond the wedge 72, as shown in FIG. 4, and thus it is not necessary to replace a broken snake 7' with a complete new snake, rather the two ends of the rupture may be reunited by a screw connection 10'. Retraction will, of course, automatically stop as each such screw connection 10' abuts the wedge 72, but by merely slightly raising the snake 7', each such screw connection 10' can be lifted generally to the position shown in FIG. 24 sliding over the wedge 72 for continued retraction.

Although a preferred embodiment of the invention has been specifically illustrated and described herein, it is to be understood that minor variations may be made in the apparatus without departing from the spirit and scope of the invention, as defined the appended claims.

What is claimed is:

1. Equipment for storing and advancing an elastic member for pulling a cable into a cable protecting pipe comprising a housing (1), a storage drum (2) having an annular storage chamber defined by an upper wall 29, inner and outer radially spaced peripheral walls (30, 31) and a base wall (32), an elastic member (7) wound within said annular storage chamber, said storage drum (2) having an aperture in one of said walls through which projects an end portion of said elastic member (7), said storage drum (2) having an opening through which projects said elastic member end portion, a handle (5) drivingly connected to said storage drum for rotating said storage drum (2) relative to said housing, said storage drum (2) being rotatably seated in an opening defined by said housing (1), and said handle (5) having a flexible portion (22) passing through said storage drum (2) and cooperative with means (28) of said housing (1) for rotatably and readily releasably coupling and uncoupling said storage drum (2) relative to said housing (1) such that said storage drum (2) and elastic member (7) therein are simultaneously bodily removable from said housing opening and are exchangeable as a unit via said housing opening.

2. The elastic member storing and advancing equipment as defined in claim 1 including a hand crank (4) connecting said handle (5) and said flexible portion (22), said hand crank (4) having a substantially conical disk portion (3), and said storage drum (2) having an upper substantially conical disk wall (43) contiguous said hand crank conical disk portion (3).

3. The elastic member storing and advancing equipment as defined in claim 1 including a hand crank (4) connecting said handle (5) and said flexible portion (22), said hand crank (4) having a substantially conical disk portion (3), said storage drum (2) having an upper substantially conical disk wall (43) contiguous said hand crank conical disk portion (3), and means (42) between said hand crank (4) and said storage drum (2) for imparting rotation of said hand crank (4) to rotation of said storage drum (2).

4. The elastic member storing and advancing equipment as defined in claim 1 including a hand crank (4) connecting said handle (5) and said flexible portion (22), a base (17) of said housing (1) having an aperture located in a substantially conical wall portion (21), and said rotatable coupling and uncoupling means (28) include a generally cylindrical bush (22) carrying a plurality of outwardly projecting catches (27) for engaging a surface contiguous said aperture.

5. The elastic member storing and advancing equipment as defined in claim 1 including a hand crank (4) connecting said handle (5) and said flexible portion (22), and said flexible portion (22) is tubular and includes a plurality of slots (26) substantially parallel to an axis of said flexible portion (22).

6. The elastic member storing and advancing equipment as defined in claim 1 including an annular gap (46) in said base wall (32), and said housing includes an upstanding boss (41) received in said annular gap (46).

7. The elastic member storing and advancing equipment as defined in claim 1 including an annular gap (46) in said base wall (32), said housing includes an upstanding boss (41) received in said annular gap (46), and said upstanding boss (41) includes an interrupted wall portion adjacent said aperture.

8. The elastic member storing and advancing equipment as defined in claim 1 including an annular gap (46) in said base wall (32), said housing includes an upstanding boss (41) received in said annular gap (46), said upstanding boss (41) includes an interrupted wall portion adjacent said aperture, and an upwardly opening channel guide (6) adjacent said interrupted wall portion.

9. The elastic member storing and advancing equipment as defined in claim 1 including an annular gap (46) in said base wall (32), said housing includes an upstanding boss (41) received in said annular gap (46), and said upstanding boss (41) includes a tapered wall portion adjacent said aperture.

10. The elastic member storing and advancing equipment as defined in claim 1 including an annular gap (46) in said base wall (32), said housing includes an upstanding boss (41) received in said annular gap (46), said upstanding boss (41) includes a tapered wall portion (49) adjacent said aperture, and an upwardly opening channel guide (6) adjacent said tapered wall portion.

11. The elastic member storing and advancing equipment as defined in claim 1 wherein said inner peripheral wall (30) carries a drum bush (33), and said housing includes an inner peripheral wall (37) defining a housing bush in telescopic relationship to said inner peripheral wall drum bush (33).

12. The elastic member storing and advancing equipment as defined in claim 1 wherein said housing (1) includes a base (17) having three feet (18, 19, 20).

13. The elastic member storing and advancing equipment as defined in claim 1 wherein said housing (1) includes an outwardly convex rest (11) generally adjacent said aperture.

14. The elastic member storing and advancing equipment as defined in claim 1 wherein said housing (1) includes a base (17) having three feet (18, 19, 20), said housing (1) includes a receptacle (14) accessible through a lid (12), and said lid (12) and feet (18–20) are disposed on opposite sides of said housing.

15. The elastic member storing and advancing equipment as defined in claim 14 wherein said housing includes opposite sides, said handle is located at one of said opposite sides and said three feet are located at another of said opposite sides.

16. The elastic member storing and advancing equipment as defined in claim 1 wherein said flexible portion (22) is tubular, said tubular flexible portion (22) carries radially outwardly directed projections (27), a shaft (64) within and coaxial to said tubular flexible portion (22), and rotatable means (63) carried by said shaft (64) for urging said projections (27) radially outwardly to a looking position and effecting the return of said projections (27) radially inwardly to an unlocking position.

17. The elastic member storing and advancing equipment as defined in claim 1 including means (59–62) for selectively locking said storage drum against rotation.

18. The elastic member storing and advancing equipment as defined in claim 1 including radially slideable means (59–62) for selectively locking said storage drum against rotation.

19. The elastic member storing and advancing equipment as defined in claim 1 including an upwardly opening guide (6) adjacent said aperture, and an outwardly rising wedge element (72) adjacent said guide (6).

20. The elastic member storing and advancing equipment as defined in claim 1 including a second storage drum carrying a second elastic member, said first-mentioned and second elastic members differing from each other in at least one of length and thickness, and said coupling and uncoupling means for said first-mentioned storage drum being constructed and arranged for readily releasably coupling and uncoupling said second storage drum relative to said housing whereby said storage drums and each associated elastic member can be selectively utilized with said housing.

21. The elastic member storing and advancing equipment as defined in claim 20 whereby said coupling and uncoupling means include first and second coupling elements carried respectively by said housing and each of said drums.

22. The elastic member storing and advancing equipment as defined in claim 20 whereby said coupling and uncoupling means include first and second telescopically interconnectable coupling elements carried respectively by said housing and each of said drums.

23. The elastic member storing and advancing equipment as defined in claim 1 wherein said storage drum includes an annular gap (46) through which passes said elastic member (7), and said housing includes means for guiding said elastic member during movement thereof through said annular gap.

24. The elastic member storing and advancing equipment as defined in claim 1 wherein said storage drum includes an annular gap (46) through which passes said elastic member (7).

25. The elastic member storing and advancing equipment as defined in claim 1 including interengaged slot and rib means for imparting drive rotation from said handle to said storage drum.

26. The elastic member storing and advancing equipment as defined in claim 25 wherein said flexible portion (22) is tubular and carries radially outwardly directed projections (27), a shaft (64) within and coaxial to said tubular flexible portion (22), and rotatable means (63) carried by said shaft (64) for urging said projections (27) radially outwardly to a locking position and affecting the return of said projections (27) radially inwardly to an unlocking position.

* * * * *